United States Patent [19]

Tanigawa et al.

[11] Patent Number: 4,468,110

[45] Date of Patent: Aug. 28, 1984

[54] METHOD AND APPARATUS FOR ELECTROPHOTOGRAPHY

[75] Inventors: Koichi Tanigawa, Tokyo; Masaharu Ohkubo, Yokohama; Masayoshi Takahashi, Chofu; Yasuyuki Tamura, Kawasaki, all of Japan

[73] Assignee: Canon Kabushiki Kaisha, Tokyo, Japan

[21] Appl. No.: 390,939

[22] Filed: Jun. 22, 1982

[30] Foreign Application Priority Data

Jun. 26, 1981 [JP] Japan ..... 56-100167

[51] Int. Cl.[3] ..... G03G 15/00

[52] U.S. Cl. ..... 355/3 TR; 355/3 R; 355/3 CH; 355/77; 355/3 DD; 430/31; 430/100

[58] Field of Search ..... 355/3 TR, 3 CH, 3 R, 355/3 BE, 3 DR, 16, 77, 3 DD, 10; 358/300; 346/153.1; 430/31, 35, 100, 902

[56] References Cited

U.S. PATENT DOCUMENTS 3,659,936 5/1972 Klose et al. ..... 355/3 R

*Primary Examiner*—Richard L. Moses

*Attorney, Agent, or Firm*—Fitzpatrick, Cella, Harper & Scinto

[57] ABSTRACT

An electrophotographic process including forming, on a photosensitive plate, an electrostatic latent image corresponding to optical information, developing the latent image by the reversal development and transferring the developed image onto a transfer material includes the improvement whereby a voltage of polarity opposite to that of the developer is applied to the photosensitive plate at least during the time from the end of the reversal development to the transfer step. This improvement in the electrophotographic process and apparatus for same prevents developer particles from being scattered away from the photosensitive plate and thereby also avoids the trouble of distortion of the image at the transfer step.

9 Claims, 20 Drawing Figures

METHOD AND APPARATUS FOR ELECTROPHOTOGRAPHY

BACKGROUND OF THE INVENTION

1. Field of the Invention

The present invention relates to a method and apparatus for electrophotography. More particularly, the present invention is directed to improvement in the method and apparatus for electrophotography in order to prevent developer particles from being scattered from the photosensitive medium into the surroundings.

2. Description of the Prior Art

Laser beam printers based on the electrophotographic process are known in the art and have the advantage that image processing can be performed at high speed. For this advantage, the 1aser beam printer has recently been employed widely as terminal printer of a computer system.

The optical system conventionally used in the electrophotographic copying machine is not necessary for the laser beam printer. The signal to be applied to it as terminal signal is signal-modulated laser beam. A high quality image can be obtained from the laser beam through substantially the same processings as required in the conventional copying machine.

In the laser beam printer, laser beam modulated by an information signal is applied to a photosensitive medium to form a corresponding image on it. For the laser application there has been generally used the so-called image scan method. According to it, the laser beam is applied on the photosensitive medium only at the portion corresponding to data signal such as character. To the remaining portion corresponding to background there is applied no laser beam. However, it is also known to apply the laser beam not to the image portion but to the background portion. This method is called background scan method. Compared with the background scan method, the first mentioned image scan method has the practical advantage that there is produced no trace of scan in the background image and there is no problem of runaway of data signal. For this advantage, the image scan system has been employed widely.

When the image scan method is applied to an image forming apparatus of the type using a Carlson type electrophotographic photosensitive medium, the formed latent image is developed by the reversal process. In the reversal development, there is used a developer charged with the same polarity as that of the latent image background portion of the photosensitive medium. The developer is applied to the latent image portion where the charge on the surface of the photosensitive medium has been decayed by the laser beam exposure. The developed image is transferred onto a transfer material for final use.

FIG. 1 schematically shows the basic arrangement of such laser beam printer according to the prior art.

Designated by 1 is a photosensitive drum comprising a photosensitive layer 2 and an electroconductive substrate 3 which is grounded. Around the photosensitive drum 1 there are arranged various processing stations only the main units of which are shown in FIG. 1.

4 is a primary charger. 5 indicates laser information light. 6 is a developing device provided with a doctor blade 7 and a magnet roller 8. 9 is developer. 10 is a pre-charger for transferring, 11 is a transfer sheet guide member and 12 is a transfer charger. 13 is a cleaning device comprising a rubber blade 14, magnet roller 15, screw 16 and casing 17.

The manner of operation of the apparatus is as follows:

At first the surface of the photosensitive drum 1 is uniformly charged by the primary charger 4 and then the drum surface is exposed to laser information light 5 the intensity of which corresponds to the terminal signal applied by the above described image scan. According to the applied information light, an electrostatic latent image is formed on the drum 1. After the exposure, the drum 1 enters the developing station where the latent image is developed by the developing device 6. At the next transfer station, the developed image is subjected to corona discharge by the pre-charger for transferring 10. Although not shown, a transfer paper sheet is supplied to the transfer station through the guide 11 in proper timing. Under the action of corona discharge from the transfer charger 12, the developed image is transferred onto the transfer sheet. After transferring, the residual developer on the drum 1 is removed off by the rubber blade 14 in the cleaning station. The removed developer is drawn to the magnetic roller 15 and then recovered in a toner recovery box by the screw 16. The toner recovery box (not shown) is formed as a part of the casing 17.

After cleaning, the drum 1 again enters the first step, that is, the primary charging step for the next cycle of operation.

FIG. 3 illustrates an example of the copy obtained by the above process. 18 is a copy having a developed image 19. The developed image 19 is composed of developer and is fixed on the copy 19 to form a permanent record.

As previously noted, in the above image forming process, the laser application step is carried out according to the image scan method. Therefore, the area of the developed image 19 on the copy 18 corresponds to the portion of the drum surface which was exposed to the laser information light. The background area of the copy other than the developed image 19 corresponds to the portion of the drum surface to which no laser application was carried out.

FIG. 2 is a curve showing the change of surface potential on the drum 1 with time at the latent image forming step in the apparatus described above. In the relation curve of FIG. 2, the surface potential is plotted on the ordinate and time on the abscissa. In the shown example, the photosensitive layer 2 of the drum 1 was formed of amorphous silicon and the photosensitive layer was primarily charged with negative polarity by the primary charger 4. As seen in FIG. 2, the applied surface potential by the primary charger 4 is changed to a latent image potential in the order of about 450 V as the contrast or the difference between the dark decay and the light decay caused by the laser exposure.

FIG. 4 illustrates the image after development. The surface potential on the drum is plotted on the ordinate. The abscissa indicates the direction of the length of the drum surface. The background $V_D$ is a negative potential portion having no toner adhered thereon. The laser exposed portion $V_L$ is at a potential near the ground potential and has negativecharged toner adhered thereon.

As previously noted, the latent image formed on the photosensitive drum is developed in the manner of reversal development. Consequently, the retention force with which the electrostatic latent image retains the developer thereon is relatively weak. In addition, in the shown type of apparatus, an electric field tending to separate the developer away from the photosensitive drum surface is produced between the drum surface and a member adjacent to it such as developing device, transfer guide or cleaner. Because of it, there occurs the phenomenon of scattering of developer in this type of apparatus. This undesirable phenomenon will be described in detail with reference to FIG. 5.

FIG. 5 schematically shows the imaginary lines of electric force produced between the drum surface 1 and a grounded conductor adjacent to the surface, for example, the casing 17 of the cleaning device. Since the polarity of charge on the drum surface is negative as a whole, the lines of electric force run toward the drum surface 1 from the tip end of the conductor 17. Therefore, an especially high density of electric force lines is produced at the tip portion of the conductor. The toner on the drum surface is, therefore, subjected to a drawing force which tends to draw the developer toward the open tip portion of the cleaner casing 17. Thereby, the developer particles are separated from the drum surface and the separated developer particles scatter over in the machine. The result is a contamination of the machine with particles.

To improve the retention of developed image while employing the above image scan system, there may be used the following electrophotographic method:

The method uses a photosensitive medium basically composed of an electroconductive layer, a photoconductive layer and an insulating layer. The surface of the photosensitive medium is primarily charged with a selected polarity and then exposed to the beam of light modulated according to the data signal in accordance with the image scan method in which said data portion means ON. Simultaneously with the beam exposure, a secondary charge with the opposite polarity to that of the primary charge is applied on the photosensitive medium by use of corona discharge means etc. with sufficiently high voltage being applied to said means. Thereafter, the whole surface of the photosensitive medium is subjected to a uniform exposure to form a latent image thereon.

In the electrophotographic method, the light portion (data portion) of the formed latent image has a high potential whose polarity is the same as that of the secondary charge. Therefore, by selecting a developer charged with the same polarity as that of the primary charge, the latent image can be developed without the above-mentioned trouble of scattering of developer.

However, this electrophotographic method involves another difficult problem. As a result of the secondary charge, there is produced at the dark portion an electric field with the opposite polarity. The top insulating layer and the underlying photoconductive layer of the photosensitive medium get in the state sandwiched in the produced electric field. This opposite polarity electric field leads to the problem that there remains some hysteresis in the layers of the photosensitive medium. When image formation is carried out continuously and repeatedly, it is made impossible to apply a sufficient amount of charge onto the portion having such hysteresis. In case of the normal development, the portion becomes white. In the reversal development described above, an unduly thickened portion results from such hysteresis. Such poor quality image is unacceptable. Because of this possibility of poor quality image, the electrophotographic method has hardly been used until now.

When the photosensitive medium of three layer structure was used, therefore, it was required to use a lower voltage for the secondary charge with the opposite polarity thereby reducing the possibility of hysteresis remaining in the photosensitive medium. Otherwise, it was required to carry out AC discharge instead of the application of voltage with the opposite polarity or to use AC biased by DC. However, even when these modified methods are employed, there occurs again the same problem of scattering of developer as in the above Carlson's system.

In any case, when the developed image on the photosensitive medium is weak in retention, there is often caused distortion of image at the transfer step. This distortion of transferred image is attributable to the fact that the transfer of the developed image takes place prematurely before the transfer material has sufficiently come close to or come into contact with the photosensitive medium. Thereby, the image is transferred on the transfer material in a position shifted from the position in which the image must be transferred when the transfer material and the photosensitive medium are in good state of contact for transferring. Some developer early separated from the photosensitive medium surface forms specks scattered around the transferred image. Thus, there is obtained distorted image on the transfer material.

Especially when the above Carlson's system is employed, the same polarity charge remains not only in the dark part but also in the light part. This is because the level of laser beam usually applied to the photosensitive medium for exposure is insufficient to completely erase the charge on the exposed part (light part). Since the polarity of such residual charge is the same as that of the developer applied to the light part, the developer is repelled by the residual charge. This enhances the problem of scattering of developer and therefore, the problem of distortion of the transferred image. The problem of residual charge occurs also even when the latent image is formed employing a three layer type photosensitive medium for the purpose described above. In this case, the residual charge is produced in the half-tone portion. The residual charge has the same polarity as that of the dark portion. Therefore, the residual charge repels the developer applied to the half-tone portion. In this manner, like the above Carlson process, this process also has the problem of scattering of developer and of the distorted image on the transfer material when reversal development is employed.

SUMMARY OF THE INVENTION

Accordingly, it is the general object of the invention to provide a novel and advantageous method and apparatus for electrophotography.

It is a more specific object of the invention to provide an electrophotographic method and apparatus which does not produce the problem of scattering of developer while employing the reversal development.

It is another object of the invention to provide an electrophotographic method and apparatus which enables obtention of a good image developed by reversal development without any trouble of distortion of the image at transferring.

The method and apparatus of the invention attaining the above objects is characterized in that at least during the time from the formation of developed image to the transfer of the same there is applied to the electroconductive substrate of the photosensitive medium a developer attracting voltage of the opposite polarity to that of the charge on the developer.

Other and further objects, features and advantages of the invention will appear more fully from the following description.

DESCRIPTION OF PREFERRED EMBODIMENTS

Figure 6:
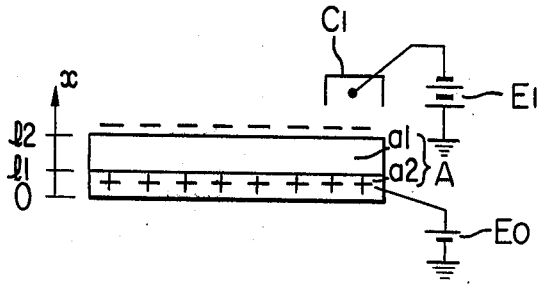
FIGS. 6a–6d illustrate a concrete process according to the invention.
Figure 6:
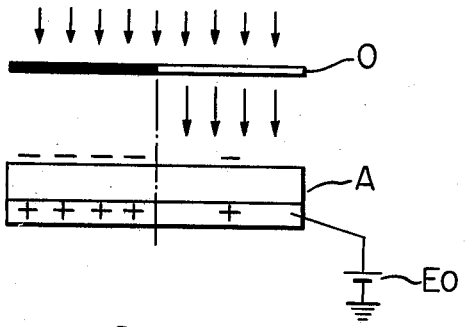
Figure 6:
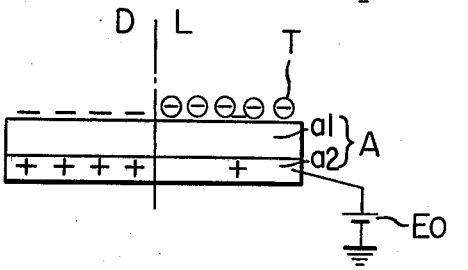
Figure 6:
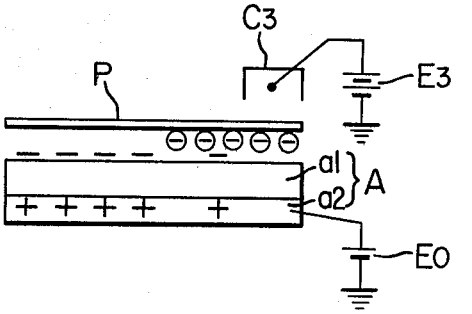

Referring to FIG. 6 (*a*) through (*d*) illustrating an embodiment of the process according to the invention, A depicts a photosensitive medium comprising an electroconductive substrate $a_2$ and a photoconductive layer $a_1$ on the substrate. To form the photoconductive layer $a_1$ there may be used any suitable photoconductive material such as ZnO, Se, CdS, amorphous silicon or organic photoconductive substances (OPC) alone or in combination. The electroconductive substrate $a_2$ is of a metal such as aluminum. In the shown embodiment, the photosensitive medium A is composed of an aluminum substrate and a layer of amorphous silicon applied thereon.

At the first step (FIG. 6 (*a*)), the surface of the photosensitive medium A is uniformly charged by means of a corona discharger $C_1$. $E_1$ is a power source. At the time, electric charges of the opposite polarity (positive) are induced in the substrate $a_2$ according to the applied charge on the surface of the photosensitive medium. Also, at this step, a determined voltage with the opposite polarity to that of the above corona discharge is applied to the conductive substrate $a_2$. As will be described later, it is desirable for the applied voltage to have a sufficiently high voltage level to draw the developer. Preferrably, the opposite polarity voltage is such voltage sufficient to lower the surface potential resulting from the above uniform charge to a level near zero potential. This application of the opposite polarity voltage serves also to accelerate charging and to lessen the charge load.

The second step shown in FIG. 6 (*b*) is a step for the application of optical information. At this step, the photosensitive medium surface is exposed to the light carrying information according to the principle of the image scan system. For the application of information there may be used not only beam of light from CRT or laser but also ordinary original, microfilm etc. In the shown embodiment, a transmission type negative image original O is used for the sake of example. As the result of light exposure, the resistance of the photoconductive layer $a_1$ drops down at the light portion of the photosensitive medium surface. Therefore, the charge on the photosensitive medium decreases rapidly. However, in case of the conventional light exposure, there remains some amount of charge. In the figure, such residual charge is schematically illustrated by a pair of charges having opposite polarities to each other. At the dark portion of the photosensitive medium, the state of charge remains almost unchanged.

The third step shown in FIG. 6 (*c*) is a developing step. At this step, the electrostatic latent image formed on the surface of the photosensitive medium according to the applied optical information is developed with a developer T charged with negative polarity. As shown in FIG. 6 (*c*), the developer cannot adhere on the dark portion D having a charge of the same polarity as the developer T. The developer T selectively adheres on the light portion L which has substantially no charge of the same polarity as the developer. In this manner, a reversal development is performed at this step.

The developer T is properly retained on the photosensitive medium by aid of the opposite polarity voltage applied to the conductive substate $a_2$ from the power source $E_0$. The applied bias voltage has also an effect to change the direction of action of the electric field formed between the photosensitive medium and the members arranged around it. As previously noted, in the prior art process, such electric field acts in the direction to cause the developer to be separated from the surface of the photosensitive medium. In contrast, in the process according to the invention, the formed electric field acts in the direction to prevent the developer from being separated from the surface of the photosensitive medium, owing to the applied bias voltage. Therefore, the problem of scattering of developer mentioned above is solved.

The fourth step shown in FIG. 6 (*d*) is a transferring step. At this step, a transfer material P comes sufficiently close to or comes into close contact with the surface of the photosensitive medium and the developed image is transferred onto the transfer material P from the photosensitive medium under the action of transfer corona discharge. The corona discharge is applied to the transfer material from its backside by a corona discharger $C_3$. A power source $E_3$ is provided to apply to the transfer corona discharger a voltage of the opposite polarity to that of the developer T. At this transfer step also, a bias voltage of the opposite polarity to the developer is being applied to the substrate $a_2$ from the power source $E_0$ to improve the retention of the developer on the photosensitive medium. Therefore, there is no problem of the developer being prematurely moved to the transfer material before the photosensitive medium and the transfer material get in good contact state for transferring. This prevents the distortion of the transferred image described above. Thus, good transfer can be attained.

After transferring, the residual developer on the photosensitive medium is removed at the next cleaning step. Even during the time from the above transfer step to the cleaning, the application of the developer drawing voltage to the substrate $a_2$ may be continued. An additional effect to prevent the contamination of the apparatus with developer particles may be obtained by it.

After cleaning, the photosensitive medium is prepared for the next cycle of the above process.

When the bias voltage is applied to the substrate of the photosensitive medium at the latent image forming step according to the method of the invention, it has an effect to accelerate the charging of the photosensitive medium as described above. To obtain the object of the invention, namely the prevention of developer from scattering, the application of the bias voltage to the substrate must be done at least during the time from development to transfer. At other steps, the application of the bias voltage may be omitted. If an endless moving photosensitive medium is used, the electroconductive substrate may divided into sections and the bias voltage may be applied to selected sections only to attain the above objects.

An embodiment of apparatus for carrying out the above process according to the invention will be described hereinafter with reference to FIG. 7.

Figure 1:
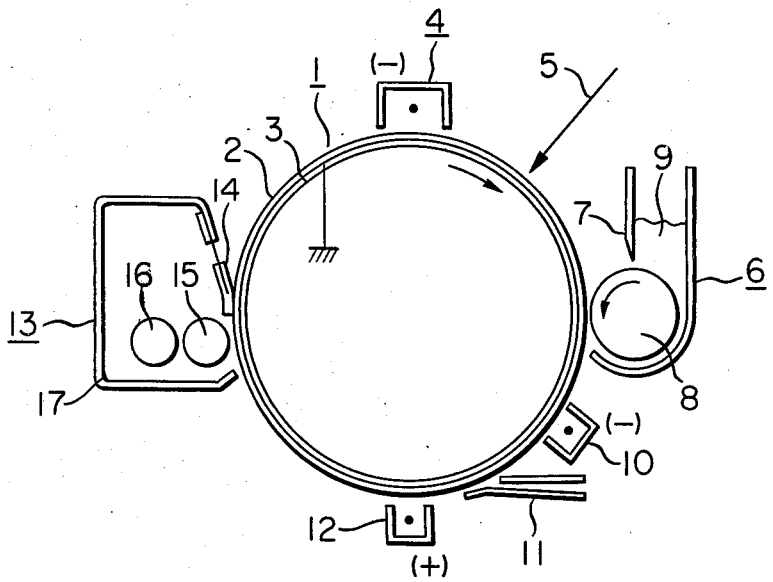
FIG. 1 (PRIOR ART)
FIG. 1 is a view illustrating a prior art laser printer.
Figure 7:
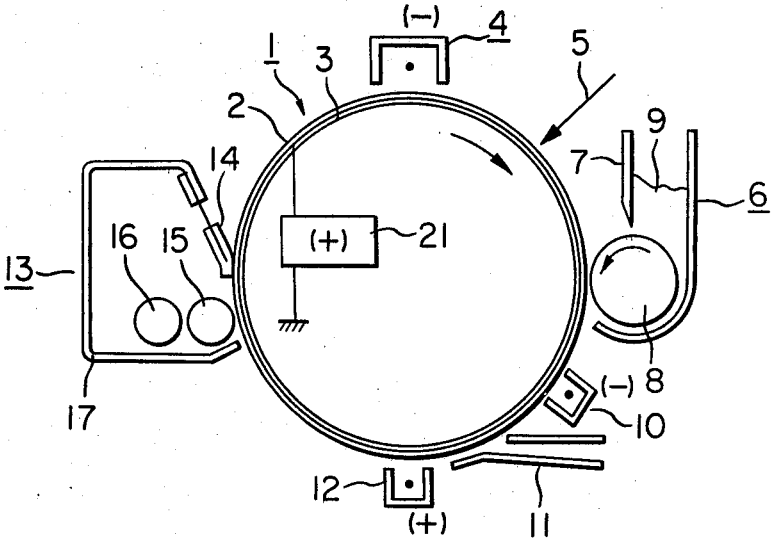
FIG. 7 shows an embodiment of the apparatus according to the invention.

In FIG. 7, like reference characters to FIG. 1 designate the same or corresponding members. As the developer 9 there is used a magnetic single-component developer. Compared with two-component developer, single-component developer has the advantages that it is less deteriorated by long use and that it is scarcely subjected to density change by over-supply of toner or change in quality of supplied toner. Of course, two-component developer also may be used in the invention.

The magnetic one-component developer is applied on a magnet roller 8 as a uniform thick layer by a doctor blade 7. At the position where the distance between the photosensitive drum 1 and the magnet roller 8 is the smallest, the developer on the magnet roller 8 is drawn to the latent image portion on the drum by the action of electric force whereby the latent image is developed. The developer is composed of fine particles (generally called "toner"). When the toner is contacted with the magnet roller 8 or doctor blade 7, the toner is electrically charged with a definite polarity. In addition, a suitable bias voltage is applied to the magnet roller 8. These produce the above electric force to attract the toner toward the latent image.

The shown apparatus according to the invention is different from the prior art apparatus shown in FIG. 1 in the point that the electroconductive substrate 3 of the photosensitive drum 1 is connected to the ground potential through a bias voltage source 21. With this arrangement, the polarity of the potential in the substrate 3 is opposite to the polarity of discharge from the primary charger 4 and also to the polarity of charged developer 9. The substrate 3 of the photosensitive drum 1 is kept in the state of the opposite polarity potential throughout all the steps of the process, namely the charging step by the primary charger 4, the exposure step by the laser beam 5, the reversal development step by the developer 6 and the transferring step by the transfer corona discharger 12. Furthermore, even during the cleaning step and the following repeated image forming cycle, the opposite polarity potential on the substrate 3 is maintained by the bias voltage source.

The connection between the bias voltage source 21 and the drum substrate 3 is accomplished by a slip ring (not shown) provided on the rotation shaft of the drum 1. The drum substrate 3 is electrically isolated from the main body of the copying machine in a suitable manner, for example, by making the drum flange (not shown) from an insulating material.

Figure 8:
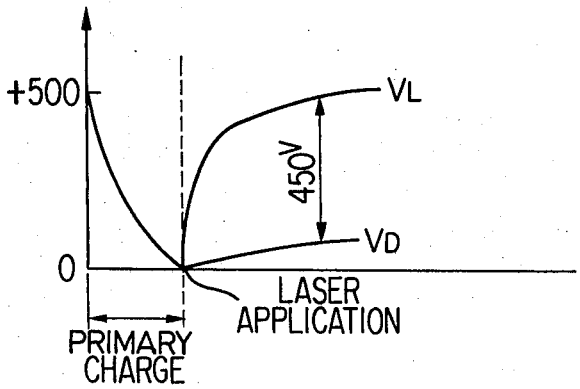
FIG. 8 is a graphical view showing the change of surface potential on the photosensitive medium in the apparatus shown in FIG. 7.

FIG. 8 shows the behavior of the surface potential on the drum 1 during the formation of a latent image.

In the shown case, the latent image contrast potential was +450 V. The substrate 3 was kept at a bias potential of +500 V by the bias voltage source 21. The bias potential is a little higher than the contrast potential.

Figure 2:
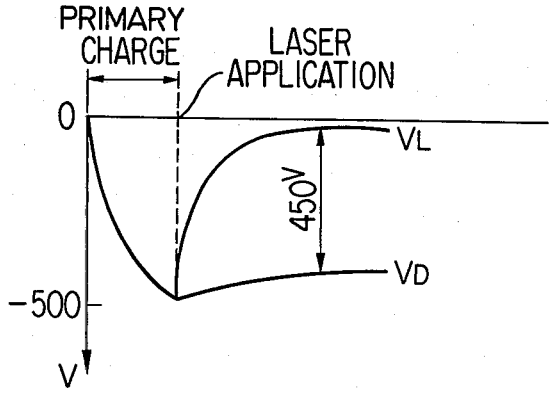
FIG. 2 (PRIOR ART)
FIG. 2 is a graphical view showing the change of surface potential on the photosensitive medium in the apparatus shown in FIG. 1.
Figure 3:
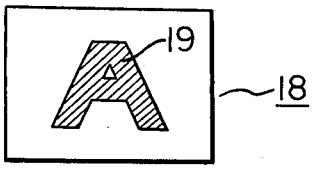
FIG. 3 shows an example of a copy made with the apparatus.

The drum surface is uniformly charged by the primary charge and the surface potential on the drum is set to about 0 V by it. At the laser exposure step, a laser beam carrying information is applied on the drum surface having the surface potential of near 0 V. According to the intensity of the applied laser beam there takes place light decay and dark decay on the drum and the surface potential changes in the range of from light part potential $V_L$ to dark part potential $V_D$ according to the difference between light decay and dark decay. Both the light part potential $V_L$ and the dark part potential $V_D$ are positive in polarity. This is compared with the prior art case shown in FIG. 2 in which both of $V_L$ and $V_D$ are negative in polarity.

Figure 4:
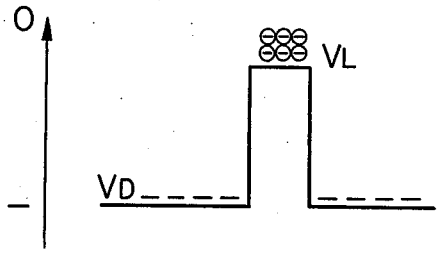
FIG. 4 (PRIOR ART)
FIG. 4 is an illustrative view of a developed potential latent image.
Figure 9:
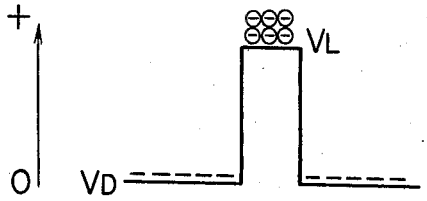
FIG. 9 illustrates the relation between the developed toner image and the surface potential.
Figure 10:
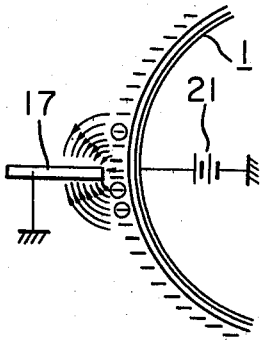
FIG. 10 illustrates the manner of development of a potential latent image as shown in FIG. 8.

FIG. 9 illustrates the relation between the toner image and the surface potential on the drum, which is compared with FIG. 4 illustrating the prior art. Comparing FIG. 9 with FIG. 4 it is seen that in case of the present invention shown in FIG. 9 there exists a surface potential of opposite polarity to the polarity of the toner in the surface area of the drum corresponding to the light part thereby improving the attraction of toner to the drum 1. Furthermore, in the background black part there exists also a surface potential of opposite polarity to the toner (the surface charge has the same polarity as the toner has). The latter mentioned opposite polarity of surface potential has an effect to make the lines of electric force between the drum surface and a grounded conductor adjacent to the drum (for example, the casing 17 of the cleaner) running in the direction opposite to the direction of the electric force lines in the prior art apparatus as will be readily understood by comparing FIG. 10 with FIG. 5. The direction of the electric force lines in FIG. 10 has an effect to push the negatively charged toner against the drum 1. Therefore, according to the invention, the retentivity of toner on the drum surface is remarkedly improved.

In the manner described above, the present invention prevents the unfavorable phenomenon of departing of toner from the drum surface and scattering of the toner in the machine. The problem of fogging of the image in the final copy and the problem of the contamination of the machine with toner particles have been solved by the present invention.

Figure 11:
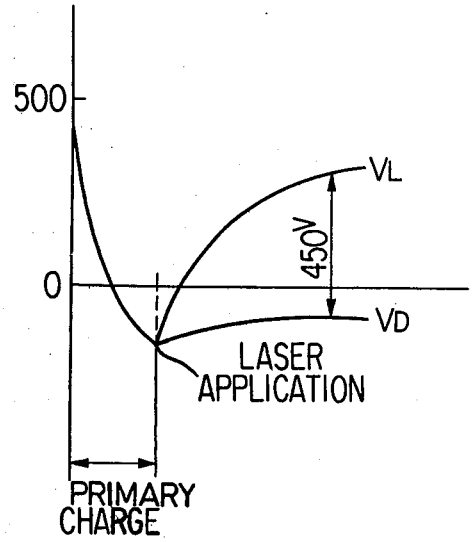
FIG. 11 illustrates the electric field formed between the photosensitive medium and the neighbouring member.

FIG. 11 shows the behavior of the surface potential on the photosensitive drum 1 at the formation of a latent image as observed when the electroconductive substrate 3 in the apparatus shown in FIG. 7 is kept at a bias potential lower than the contrast potential of the latent image.

Figure 5:
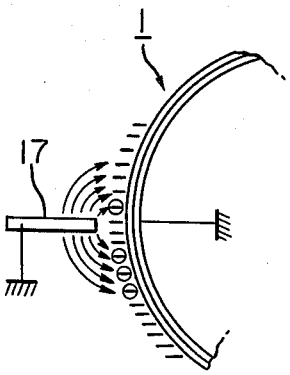
FIG. 5 (PRIOR ART)
FIG. 5 illustrates the reason why the developer is scattered.

Similar to the above described embodiment, the potential of light part $V_L$ is of opposite polarity to the toner. However, in this embodiment of FIG. 11, the potential of dark part corresponding to the background, that is, $V_D$ is a potential of opposite polarity to the toner. This latent image has the advantages that at the next development step, the application of DC bias voltage to the magnet roller 8 is dispensable which is otherwise required to prevent the background from fogging. In this embodiment, the direction of the lines of electric force between the drum 1 and the grounded conductor adjacent to the drum is nearly the same as that of the prior art as shown in FIG. 5. However, as compared with the prior art, the value of the surface potential $V_D$ on the background part is very small (for example, about 1/5). Therefore, the density of the electric force lines is far smaller than that of the prior art so that the electric force cannot produce the problem of scattering of toner.

FIG. 12 (*a*) through (*e*) illustrates another concrete process of electrophotography according to the invention.

In this process, a photosensitive medium B is used which is basically composed of an electroconductive substrate $b_1$, a photoconductive layer $b_2$ and an insulating layer $b_3$. According to the feature of the invention, bias voltage for attracting the toner is applied to the electroconductive substrate $b_1$ at least during the time of from the end of development step to the completion of the transfer step.

The photoconductive layer $b_2$ of the photosensit1ve medium may be formed of any desired photoconductive material selected from the group consisting of ZnO, Se, CdS etc. employing a known technique such as vapor deposition, resin bonding etc. The photoconductive layer of the shown example is a layer of Se-Te alloy formed by vapor deposition.

The first step shown in FIG. 12 (*a*) is a primary charge step at which the whole surface of the photosensitive medium B is uniformly charged with a selected polarity (negative) by a primary corona discharger $C_1'$. $E_1'$ is a power source. The electroconductive substrate $b_1$ is connected with a voltage source $E_0'$ by which a voltage of opposite polarity (positive) to that of the primary charge is applied to the substrate. The applied voltage of opposite polarity (positive) is so selected as to set the surface potential to about 0 (zero) V after the primary charge.

The second step shown in FIG. 12 (*b*) is a step for AC discharging simultaneous with information light exposure. At this step, an information light exposure similar to that in FIG. 6 is carried out. However, in this embodiment, AC discharging is carried out simultaneously with the exposure. The AC discharge is carried out by a secondary corona discharger $C_2'$ connected to AC power source $E_2'$ with a positive DC voltage superimposed threreon. The level of the superimposed DC voltage is nearly equal to the applied voltage by the above power source $E_1'$. AC discharge may be carried out by use of only DC corona discahrge with the opposite polarity to that of the primary charge. By this AC discharge, a large portion of the surface charge on the light portion (L) is removed and only a small amount of charge is left remaining in the portion. But, in the dark portion (D) of the photosensitive medium, the surface charge is not removed so much. Consequently, the surface potential rises up again to a level near the applied voltage by the power source $E_0'$.

The third step shown in FIG. 12 (*c*) is a whole surface exposure step. At this step, the positive charge which was in an unbalanced state in the interface of the dark part at the previous step, is released and allowed to move into the conductive substrate $b_1$. Therefore, the surface potential on the dark portion drops down. On the contrary, at the light portion, there occurs no remarkable change of the surface potential because the charge at the light portion was nearly balanced at the previous second step.

The fourth step shown in FIG. 12(*d*) is a developing step. At this step, the light part (L) is developed with a developer T' of the same polarity (negative) to that of the primary charge. The applied developer T' on the photosensitive medium is under the attraction force given by the applied voltage from the power source Eo'. This attraction force prevents the developer T' from scattering in the environment around the photosensitive medium during the following steps of the process.

The fifth step shown in FIG. 12(*e*) is a transfer step. At this step, a transfer corona discharger $C_3'$ applies transfer corona to the transfer material P' from the backside thereof. Under the action of the transfer corona, the developed image is transferred onto the transfer material P' from the photosensitive medium. The developer attracting voltage applied to the substrate $b_1$ of the photosensitive medium by the power source $E_0'$ prevents any premature transfer of the developer at this transfer step. Therefore, transferring is performed well without any problem of distortion of transferred image.

In this embodiment also, it is not always necessary to maintain the application of the developer attracting voltage throughout all the steps of the process. The thing essential for the purpose of the invention is to apply the developer attracting voltage to the substrate of the photosensitive medium at least during the time from the end of development step to the completion of transfer step.

Of course, it is possible to continue the application of the bias voltage even after the transfer step and before the cleaning step. An additional effect to prevent the contamination of the machine may be attained by doing so.

An embodiment of the apparatus for carrying out the above process will be described hereinafter with reference to FIG. 13 in which like reference characters to FIG. 7 designate the same or corresponding elements.

Figure 13:
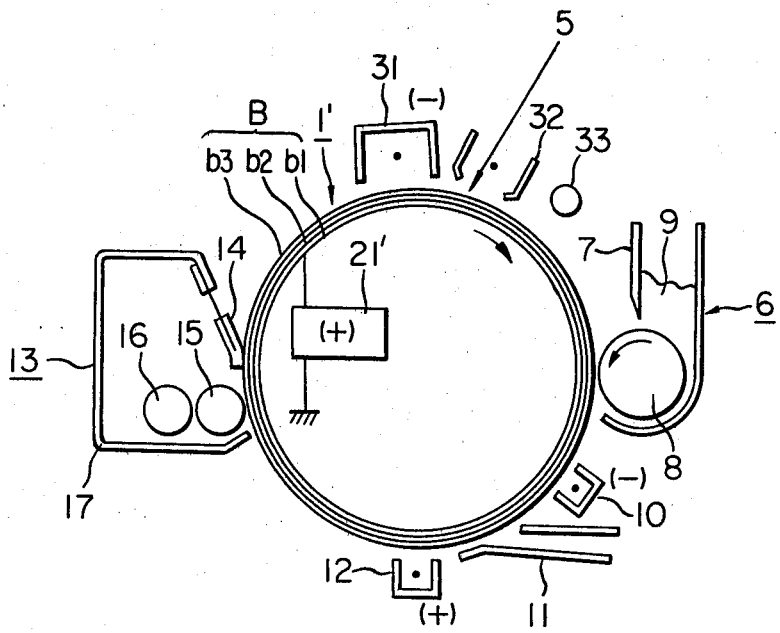
FIG. 13 shows another embodiment of the apparatus according to the invention.
Figure 12A:
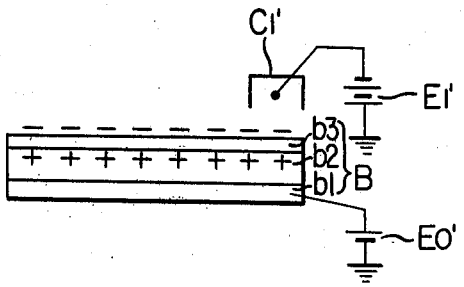
FIGS. 12a–12e illustrate another concrete process according to the invention.
Figure 12B:
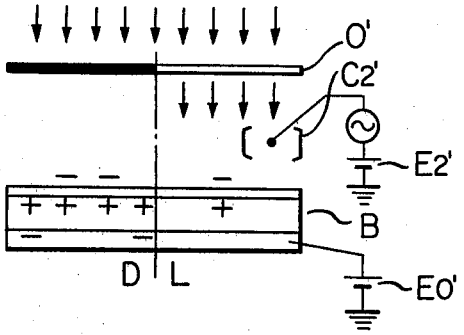
Figure 12C:
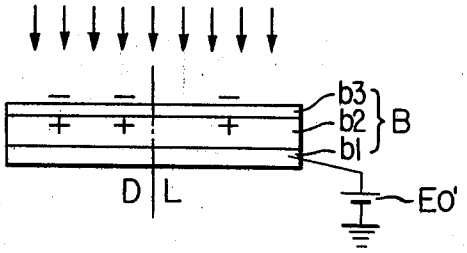
Figure 12D:
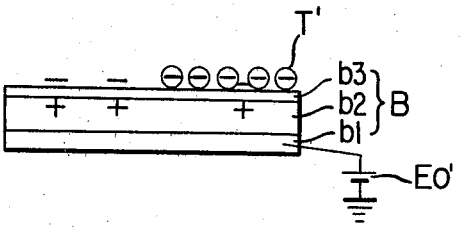
Figure 12E:
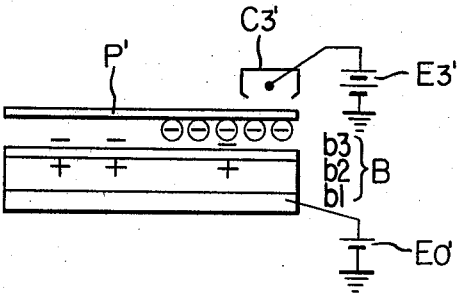

The embodiment shown in FIG. 13 is different from that in FIG. 7 in the following points:

The photosensitive medium B used in FIG. 13 embodiment is of three layer structure which is basically composed of an electroconductive substrate $b_1$, a photosensitive layer $b_2$ and an insulating layer $b_3$; and Latent image forming means comprises a primary corona discharger 31, a secondary corona discharger 32 whose backside is optically opened and a whole surface exposure lamp 33.

21' is a bias voltage source which applies to the photosensitive medium a voltage of the opposite polarity to that of the applied voltage by the primary corona discharger. The developer 9 is charged with the same polarity as that of the applied voltage by the primary corona discharger.

The manner of operation of the apparatus is as follows:

Initially, the surface of the photosensitive drum 1' is uniformly charged with negative polarity by the primary corona discharger 31. The negatively charged drum surface is then exposed to the information light 5 according to the image scan method. Simultaneously with it the drum surface is subjected to the corona discharge containing a positive polarity component by the secondary corona discharger. Thereafter, the drum surface is uniformly exposed to the light from the whole surface exposure lamp 33 so that an electrostatic latent image is formed on the drum surface. The photosensitive drum 1' enters the developing station at which the latent image is developed in the manner of reversal development by the developing device 6. Under the effect of the attraction voltage applied from the bias voltage source 21', the developed image on the drum 1' retains the position well and enters the transfer station in safe without being scattered in the machine. In the course to the transfer station, the surface of the photosensitive drum 1' is uniformly charged by a pre-transfer charger 10 and then the developed image is transferred onto a transfer material from the drum with the aid of a transfer corona discharger 12. After transferring, the drum enters the cleaning station at which the drum surface is cleaned up and is prepared for the next cycle of the process.

The following examples are given for a better understanding of the invention.

EXAMPLE 1

An image forming apparatus of the same arrangement as shown in FIG. 7 was used. The photosensitive drum was formed by applying a photosensitive layer on an aluminum layer. The photosensitive layer was formed of amorphous silicon containing hydrogen (H) and oxygen (O) and the thickness of the layer was about 30$\mu$.

For the application of optical information there was used a 780 $\mu$m semiconductor laser controlled in accordance with the image scan method. As the developing device there was used Type NP 200 commercially available. The developing agent used was a one-component magnetic developer which is also commercially available for use in the NP 200 developing device.

At first, a control experiment was conducted wherein no bias voltage was applied to the aluminum substrate of the photosensitive drum during the formation of an image.

After charging the drum surface with negative charge, optical information was applied on the drum surface to form a latent image. The surface potential produced by the application of information was −400 V at the dark portion ($V_D$) and −50 V at the light portion ($V_L$).

The latent image was developed by the above described developing device with peak-to-peak voltage: 1200 V, frequency: f=1 KHz and DC bias voltage: −250 V. The developed image was transferred onto a transfer material. At the transfer step, scattering of toner occurred and dirty specks were formed on the transfer material by the scattered toner particles. Some distortion of image was observed in the transferred image on the transfer material.

A second experiment was conducted according to the invention wherein the image formation was carried out while applying a voltage of +500 V to the aluminum substrate of the photosensitive drum.

The surface potential produced by the application of information after charging the drum surface with negative charge was +100 V at the dark portion ($V_D$) and +450 V at the light portion ($V_L$).

The latent image was developed by the same developing device as above only with the change that DC bias voltage was set to +250 V this time. The developed image was transferred onto a transfer material. At the transfer step, there was observed no scattering of toner. The transferred image was sharp and clear. No distortion of image was observed in the transferred image.

EXAMPLE 2

An image forming apparatus of the same arrangement as shown in FIG. 13 was used. The photosensitive drum was composed of an aluminum drum, a vapor deposited layer of Se-Te alloy about 70$\mu$ thick on the aluminum substrate and a transparent insulating layer about 33$\mu$ thick formed on the photoconductive layer.

Application of optical information was carried out using 780 $\mu$m semiconductor laser according to the image scan method like the above example, Example 1. The same type of developing device and developing agent (NP 200) as in Example 1 were used.

As a control experiment, an image was formed without the application of bias voltage to the aluminum substrate of the photosensitive drum.

The drum surface was charged up to −1500 V by the primary charge. A latent image was formed on the drum by charging the drum surface with the opposite polarity to the primary charge simultaneously with information light exposure. The formed latent image was of −450 V at the dark portion ($V_D$) and 0 V at the light portion ($V_L$). The latent image was developed by the above described developing device with peak-to-peak voltage: 1200 V, frequency: f=1 KHz and DC bias voltage: −225 V. The developed image was transferred onto a transfer material. At this transfer step, the toner was scattered and the scattered toner produced some dirty specks on the transfer material. Also, some distortion of image was observed in the transferred image on the transfer material.

After the above control experiment, an experiment of image formation according to the invention was conducted in the following manner:

A voltage of +500 V was applied to the aluminum substrate of the photosensitive drum. The surface of the drum was charged up to −1000 V by the primary charge. The drum surface was then charged with the opposite polarity to the primary charge simultaneously with the application of optical information to form a latent image of +50 V at the dark portion ($V_D$) and +500 V at the light portion ($V_L$). The latent image was developed in the same manner as in the above control experiment only with the change that DC bias voltage was set to +275 V this time. The developed image was transferred onto a transfer material. At this transfer step, there was observed no scattering of toner. A sharp and clear transferred image was obtained without any distortion of image.

We claim:

1. In an electrophotographic process including the steps of forming, on a photosensitive medium, an electrostatic latent image corresponding to optical information applied on said photosensitive medium, developing said electrostatic latent image by reversal development using a developer and transferring said developed image onto a transfer material, the improvement residing in that a voltage having a polarity opposite to the polarity of said developer is applied to said photosensitive medium at least during the time from the end of said reversal development to said transfer step.

2. In an electrophotographic process including the step of forming an image corresponding to an optical information applied to a photosensitive medium, the improvement residing in the steps of:

forming an electrostatic latent image on the photosensitive medium corresponding to the optical information applied to the photosensitive medium while a voltage of a selected polarity is being applied to an electroconductive substrate;

applying a developer to said optical information applied area of said photosensitive medium, said developer having a charge of the opposite polarity to the polarity of said voltage applied to the electroconductive substrate of said photosensitive medium; and transferring said developed image onto a transfer material from said photosensitive medium.

3. In an electrophotographic apparatus for forming an image on a photosensitive medium according to the optical information applied thereto, the improvement residing in the provision of:

a photosensitive medium having an electroconductive substrate;

means for forming a latent image on said photosensitive medium according to the optical information applied thereto;

developing means for applying a developer charged with a selected polarity onto the area of said photosensitive medium where said optical information has been applied; and means for applying to said electroconductive substrate of the photosensitive medium a voltage of the opposite polarity to the polarity of said developer.

4. In an electrophotographic apparatus for forming an image on a photosensitive medium according to the optical information applied thereto, the improvement residing in the provision of:

a photosensitive medium having an electroconductive substrate and a photoconductive layer provided thereon;

means for applying to the surface of said photosensitive medium a selected polarity of charge;

means for applying an optical information to the surface of said photosensitive medium;

developing means for applying a developer charged with the same polarity as that of said applied charge; and means for applying to the electroconductive substrate of said photosensitive medium a voltage of the opposite polarity to that of said charged developer.

5. The improvement as set forth in claim 4, wherein said photosensitive medium is supported for endless movement.

6. The improvement as set forth in claim 4, wherein said optical information applying means comprises an information part from which a beam of light is emitted toward said photosensitive medium.

7. An electrophotographic apparatus for forming an image on a photosensitive medium according to the optical information applied thereto, said apparatus comprising:

a photosensitive medium basically composed of an electroconductive substrate, a photoconductive layer and an insulating layer;

means for applying on the surface of said photosensitive medium a primary charge of a selected polarity;

means for applying the optical information on said surface;

means for applying on said surface a charge containing a component of the opposite polarity to that of said primary charge nearly simultaneously with said application of optical information;

means for whole surface exposure;

developing means for applying on said surface a developer charged with the same polarity as that of said primary charge; and means for applying to the electroconductive substrate of said photosensitive medium a voltage of the opposite polarity to that of said charged developer.

8. An electrophotographic apparatus as set forth in claim 7, wherein said photosensitive medium is supported for endless movement.

9. An electrophotographic apparatus as set forth in claim 7, wherein said optical information applying means comprises an information part from which a beam of light is emitted toward said photosensitive medium.

* * * * *

UNITED STATES PATENT AND TRADEMARK OFFICE

CERTIFICATE OF CORRECTION

PATENT NO. : 4,468,110

DATED : August 28, 1984

INVENTOR(S) : KOICHI TANIGAWA, ET AL.

It is certified that error appears in the above-identified patent and that said Letters Patent is hereby corrected as shown below:

Column 1, line 18, change the "1" in "laser" to an "l".
Column 2, line 63, change "negativecharged" to --negative-charged--.
Column 4, line 37, delete comma after "therefore";
Column 6, line 34, change "substate" to --substrate--.
Column 7, line 21, insert "be" between --may-- and --divided--.
Column 9, line 55, change "discahrge" to --discharge--.
Column 10, line 12, change "Eo'" to --$E_o$'--.
Column 11, line 11, change "in safe" to --safely--.

Signed and Sealed this

Ninth Day of July 1985

[SEAL]

*Attest:*

DONALD J. QUIGG

*Attesting Officer* *Acting Commissioner of Patents and Trademarks*